US006202550B1

(12) United States Patent
Lee et al.

(10) Patent No.: US 6,202,550 B1
(45) **Date of Patent: *Mar. 20, 2001**

(54) PRINTER AND METHOD FOR PRINTING INDICIA ON A COMPACT DISK USING A PLURALITY OF INK JET OR LASER ROTATABLE PRINT HEADS

(75) Inventors: Yung-Rai Lee, Pittsford; Constantine N. Anagnostopoulos, Mendon; Alfred J. Amell, Spencerport, all of NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/223,258

(22) Filed: Dec. 30, 1998

(51) Int. Cl.[7] ..... B41J 2/455; B41J 2/145

(52) U.S. Cl. ..... 101/38.1; 101/35; 101/93.11; 101/93.17; 347/37; 347/38; 347/233; 400/118.2

(58) Field of Search ..... 101/35, 38.1, 41, 101/44, 93.11, 93.17, 93.18; 347/37, 38, 233, 245; 400/118.2

(56) References Cited

U.S. PATENT DOCUMENTS

| | | | | |
|---|---|---|---|---|
| 3,786,517 | * | 1/1974 | Krause | 347/90 |
| 4,066,268 | | 1/1978 | Borchard et al. | 369/280 |
| 4,731,621 | * | 3/1988 | Hayamizu et al. | 347/20 |
| 4,998,238 | * | 3/1991 | Mizunoe et al. | 369/116 |
| 5,317,337 | | 5/1994 | Ewaldt | 400/70 |
| 5,518,325 | | 5/1996 | Kahle | 156/384 |
| 5,552,009 | | 9/1996 | Zager et al. | 156/220 |
| 5,781,221 | * | 7/1998 | Wen et al. | 347/232 |
| 5,797,688 | | 8/1998 | Wen | 400/48 |
| 5,927,208 | * | 7/1999 | Hagstrom et al. | 101/35 |
| 5,967,676 | * | 10/1999 | Cutler et al. | 101/35 |

FOREIGN PATENT DOCUMENTS

| | | | | |
|---|---|---|---|---|
| 31421 | * | 7/1981 | (EP) | 347/37 |
| 2320912 | | 7/1998 | (GB) . | |
| 58-58876 | * | 5/1981 | (JP) . | |
| 5-124182 | * | 5/1993 | (JP) | 347/38 |
| 5-238005 | * | 9/1993 | (JP) . | |
| 6-31906 | * | 2/1994 | (JP) . | |
| 9-265760 | * | 10/1997 | (JP) . | |
| 9701844 | | 1/1997 | (WO) . | |

OTHER PUBLICATIONS

Johnson, "Mechanism for Printing Concentric Circles for Use as Coded Indicia"; IBM Technical Disclosure Bulletin, vol. 15, No. 3, pp. 974–975, Aug. 1972.*

* cited by examiner

*Primary Examiner*—John S. Hilten
*Assistant Examiner*—Daniel J. Colilla
(74) *Attorney, Agent, or Firm*—Walter S. Stevens

(57) ABSTRACT

A printer and method for printing indicia on a disk. According to an embodiment of the invention, a printer comprises a plurality of elongate print heads arranged orthogonally with respect to each other about a center axis defined between the print heads. The print heads are capable of printing indicia on a disk having an annular printing area. The disk may be a recordable compact disk or a read-only memory compact disk, if desired. The print heads may be coupled to a rotatable hub centered at the center axis, such that the print heads extend radially outwardly from the hub. A motor is coupled to the hub for rotating the hub, so that the print heads rotate in unison about the center axis as the hub rotates. A controller coupled to the motor and print heads synchronously control operation of the motor and print heads. In this configuration of the invention, the print heads rotate while the disk is stationary.

60 Claims, 10 Drawing Sheets

PRINTER AND METHOD FOR PRINTING INDICIA ON A COMPACT DISK USING A PLURALITY OF INK JET OR LASER ROTATABLE PRINT HEADS

BACKGROUND OF THE INVENTION

This invention generally relates to printer apparatus and methods and more particularly relates to a printer and method for printing indicia on a disk, such that printing speed is increased and printing costs are reduced.

Compact disks are generally of two types. One types of compact disk is commonly referred to as a recordable compact disk, which is insertable into a compact disk recorder. A user then records digital data onto the compact disk by means of an input device, such as a computer connected to the recorder. The recordation is typically performed using laser light impulses that "burn" the digital data into the recordable disk in binary code. This digital data may then be optically read by a suitable compact disk player. Thus, the recordable compact disk allows the user to write data onto the disk. Another type of compact disk is commonly referred to as a read-only memory compact disk, which has the digital data already "burned" into the disk when received by the user. In this case, the user may only read the digital data by means of the compact disk player and may not write data onto the disk. Recordable and read-only memory compact disks are becoming more prevalent due to their lower cost, compact size and easier data retrieval compared, for example, to magnetic data storage.

In any case, it is important to label the compact disk for the purpose of identifying the data content of the disk. Such identification facilitates archiving of a plurality of disks having different data content and also facilitates distribution of large data files. This labeling may be obtained in several ways. For example, read-only memory compact disks are typically labeled using a silk-screen printing process because read-only memory compact disks are usually mass produced and silk-screen printing is particularly suitable for mass produced articles. Printing on recordable compact disks, on the other hand, is typically produced by manually writing identification information on a label and attaching the label to the disk or by using a felt-tip stylus to write directly on the surface of the disk itself. However, with respect to the silk-screen process, rapid change-over to print different label information on different compact disks is not readily possible thereby resulting in an inflexible manufacturing process. Of course, manually writing identification information on the disk is time-consuming and thereby costly.

A method of printing label information on a disk is disclosed in U.S. Pat. No. 5,317,337 titled "Printing Method For Disc-Shaped Information Carriers" issued May 31, 1994 in the name of Helmut Ewaldt. This patent discloses a data-processing system including a printer head movable radially over an annular area of a disc-shaped information carrier to print in the annular area The printer head prints a radial line label information starting at an inner edge of the annular area up to an outer edge of the area. After the line is printed, the disc-shaped information carrier is rotated through a given angle whereupon another radial line of label information is printed. This process is continued until the information carrier has made one full revolution and the entire annular area has been printed. Printing is controlled by a printing program in a data-processing system, which also supplies the label information. However, the Ewaldt device is relatively slow in printing because the Ewaldt device uses but a single printer head. Moreover, if an individual printing element in the printer head malfunctions, the entire printer head must be replaced if quality printing is to be maintained. Replacement of the entire printer head increases printing costs.

Therefore, there remains a need to provide a printer and method for printing indicia on a disk, such that printing speed is increased and printing costs are reduced.

SUMMARY OF THE INVENTION

An object of the present invention is to provide a printer and method for printing indicia on a disk, such that printing speed is increased and printing costs are reduced.

With the above object in view, the present invention resides in a printer for printing indicia on a disk, comprising a plurality of print heads arranged in a spoke-like configuration about a center axis defined between said print heads, said print heads capable of being disposed in printing relation to the disk.

According to an embodiment of the present invention, a printer comprises a plurality of elongate print heads arranged orthogonally with respect to each other about a center axis defined between the print heads. Each print head is capable of printing indicia on a disk having an annular printing area The disk may be a recordable compact disk or a read-only memory compact disk, if desired. The print heads may be coupled to a rotatable hub centered at the center axis, such that the print heads extend radially outwardly from the hub. A motor is coupled to the hub for rotating the hub, so that the print heads rotate in unison about the center axis as the hub rotates. A controller coupled to the motor and print heads synchronously control operation of the motor and print heads. In this configuration of the invention, the print heads rotate while the disk is stationary.

According to another embodiment of the present invention, the motor is coupled to the disk for rotating the disk. In this latter embodiment of the invention, the disk rotates while the hub and print heads remain stationary.

According to still another embodiment of the present invention, the print heads may instead be radially movable with respect to the disk while the disk rotates.

According to yet another embodiment of the present invention, each of the print heads may comprise a plurality of adjacent replaceable print head segments.

According to a further embodiment of the present invention, the printer includes an elongate print head having a predetermined length substantially equal to the diameter of the disk for printing the indicia in a printing area on the disk. A guide is coupled to the print head for translating the print head over the printing area. In this embodiment of the invention, the print head translates while the disk is stationary. A motor is coupled to the guide for moving the guide, so that the print head translates while the guide moves. This print head may include the previously mentioned plurality of adjacent print head segments.

According to still another embodiment of the present invention, a printer comprises a solitary print head extending from a center axis defined by the disk. The print head is capable of printing indicia on a disk having an annular printing area.

It should be noted that with respect to each of the embodiments mentioned hereinabove, the print heads may be ink jet print heads, laser print heads or other type of suitable print heads.

A feature of the present invention is the provision of a plurality of print heads arranged in a spoke-like configuration for printing the indicia on the disk.

Another feature of the present invention is the provision of a plurality of print heads arranged in a spoke-like configuration for printing the indicia on the disk, wherein each of the print heads comprises a plurality of adjacent print head segments.

An advantage of the present invention is that use thereof increases printing speed when printing indicia on an individual disk.

Another advantage of the present invention is that printing costs are reduced.

Still another advantage of the present invention is that use thereof allows for a flexible manufacturing process.

These and other objects, features and advantages of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following detailed description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
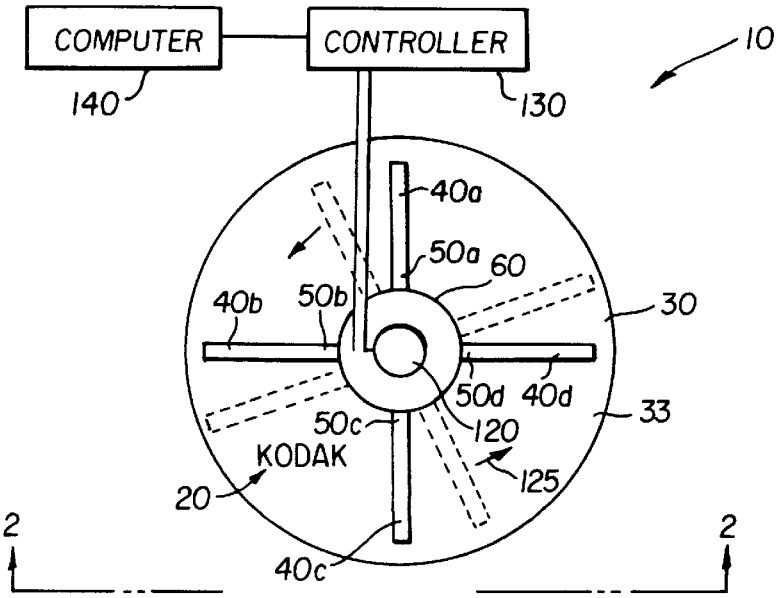
FIG. 1 is a plan view of a first embodiment printer for printing indicia on a disk, the printer comprising a plurality of ink jet print heads arranged in a spoke-like configuration, the spoke-like configuration being rotatable while the disk is stationary.
Figure 2:
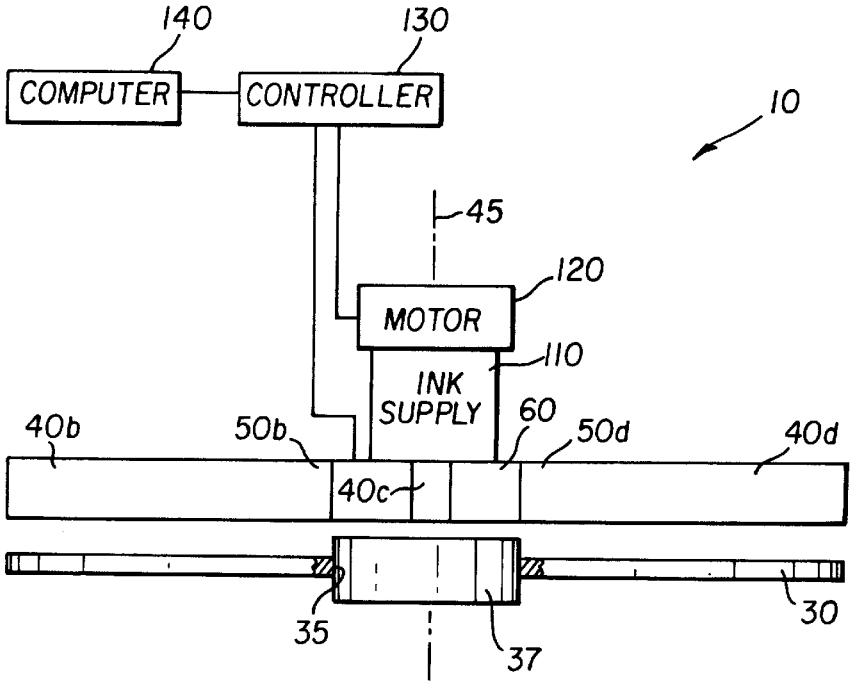
FIG. 2 is a view taken along section line 2—2 of FIG. 1.
Figure 3:
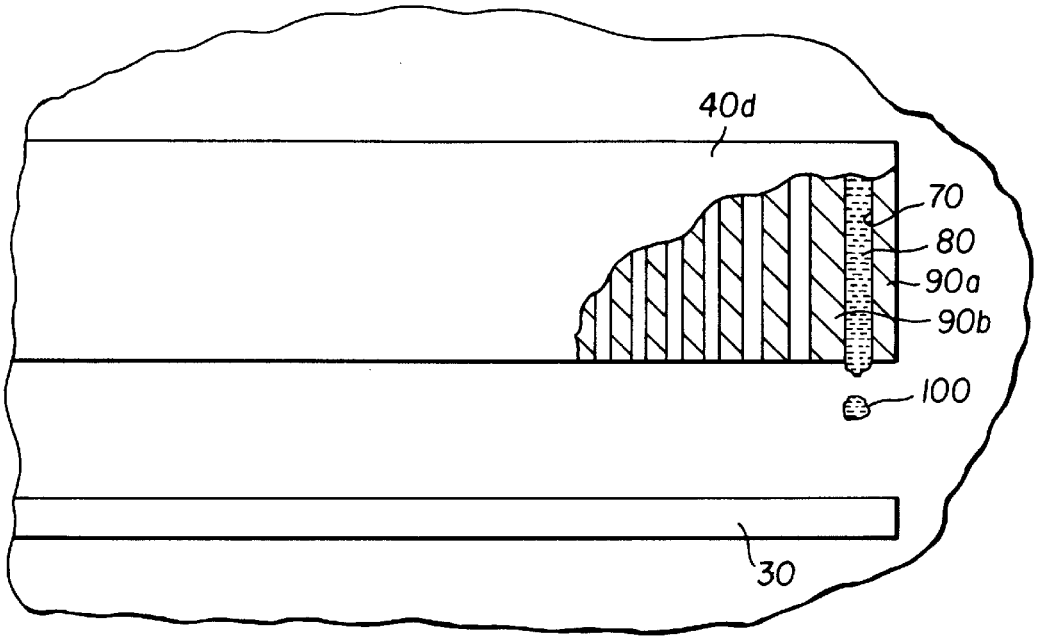
FIG. 3 is an enlarged fragmentation view in partial elevation of one of the ink jet print heads showing a plurality of ink channels therein.

Therefore, referring to FIGS. 1, 2 and 3, there is shown a first embodiment ink jet printer, generally referred to as 10, for printing indicia 20 on a generally circular disk 30 having an annular printing area 33. Disk 30 has a hole 35 through the center thereof for slidably engaging a spindle 37 that supports disk 30. That is, spindle 37 supports disk 30 as spindle 37 is received in hole 35 and slidably engages disk 30. In this regard, spindle 37 may be tapered to easily engage disk 30 as spindle 37 is received in hole 35.

Again referring to FIGS. 1, 2, and 3, disk 30 may be a so-called "compact disk". In this regard, such a compact disk may be a recordable compact disk which can have digital information recorded thereon by the user. On the other hand, disk 30 may be a so-called "read-only memory" compact disk. In this case, digital information is already imprinted on the disk when the disk is received by the user and may not be recorded upon by the user. However, it will be understood the invention is usable where disk 30 is neither a recordable compact disk nor a read-only memory compact disk. Rather, disk 30 may be any transmissive or reflective receiver (e.g., paper, polymeric plastic, wood, metal, or the like) on which indicia 20 is to be printed and need not be a recordable or read-only memory compact disk.

Referring again to FIGS. 1, 2 and 3, printer 10 comprises a plurality of elongate ink jet print heads 40*a*, 40*b*, 40*c* and 40*d* (only four of which are shown) arranged in a spoke-like configuration about a center axis 45 defined between print heads 40*a*/*b*/*c*/*d*. In other words, print heads 40*a*/*b*/*c*/*d* are arranged orthogonally with respect to each other about center axis 45 and preferable lay in the same plane. Moreover, each print head 40*a*/*b*/*c*/*d* has an end portion 50*a*, 50*b*, 50*c*, and 50*d*, respectively, coupled to a hub 60 centered at center axis 45. In addition, each print head 40*a*/*b*/*c*/*d* has a plurality of elongate channels 70 therein, each channel 70 having an ink body 80 therein. Each channel 70 may be defined by a pair of oppositely disposed sidewalls 90*a* and 90*b* formed of piezoelectric material, such as lead zirconate titanate (PZT). Such a piezoelectric material possesses piezoelectric properties such that an electric field applied thereto induces a mechanical stress in the material. As the mechanical stress is induced in the material, the material deforms in a preferred direction depending on direction of "poling" of the material. Thus, according to the invention, a selected pair of piezoelectric sidewalls 90*a* and 90*b*, which have been poled in a predetermined direction, are subjected to a suitable electric field (not shown), which electric field causes sidewalls 90*a*/*b* to inwardly deform reducing volume of chamber 70. As volume of chamber 70 is reduced, an ink droplet 100 is ejected from chamber 70 to travel toward disk 30 and be intercepted thereby. Of course, it may be appreciated that print heads 40*a*/*b*/*c*/*d* need not be piezoelectric ink jet print heads; rather, print heads 40*a*/*b*/*c*/*d* instead may be thermal ink jet print heads.

Still referring to FIGS. 1, 2 and 3, and ink supply 110 is coupled to print heads 40*a*/*b*/*c*/*d* for supplying ink thereto. It may be appreciated from the description herein that the ink residing in ink supply 110 may be a single color (e.g., black). On the other hand, ink supply 110 is capable of supplying a plurality of colored inks (e.g., cyan, magenta, yellow and black), each color being assigned to a respective one of print heads 40*a*/*b*/*c*/*d*. Moreover, a motor 120 is coupled to hub 60 for rotating hub 60 about center axis 45 while disk 30 is stationary. In this manner, print heads 40*a*/*b*/*c*/*d* rotate in unison about center axis 45 in direction of a first arrow 125 while disk 30 is stationary. Coupled to both motor 120 and print heads 40*a*/*b*/*c*/*d* is a controller 130 for controlling operation of motor 120 and print heads 40*a*/*b*/*c*/*d*. A suitable controller for this purpose is a Model CompuMotor controller available from Parker Hannifin, Incorporated, located in Rohnert Park, Calif. A user interface, such as a "personal" computer 140 with keyboard (not shown), is coupled to controller 130 for allowing manual entry of information into controller 130. This information, for example, may be the following: (a) desired speeds of hub 60 and disk 30; (b) ink colors assigned to each print head 40*a*/*b*/*c*/*d*; (c) location where indicia 20 is to be printed in printing area 33; (d) selective enablement of each channel 70 for ejecting droplets 100 from each print head 40*a*/*b*/*c*/*d*; (e) font of indicia 20; and (f) size of indicia 20. Suitable software is disposed in computer 140 and/or controller 130 to allow communication of this information from computer 140 to controller 130. Suitable software for this purpose is commercially available or may be readily written.

Figure 4:
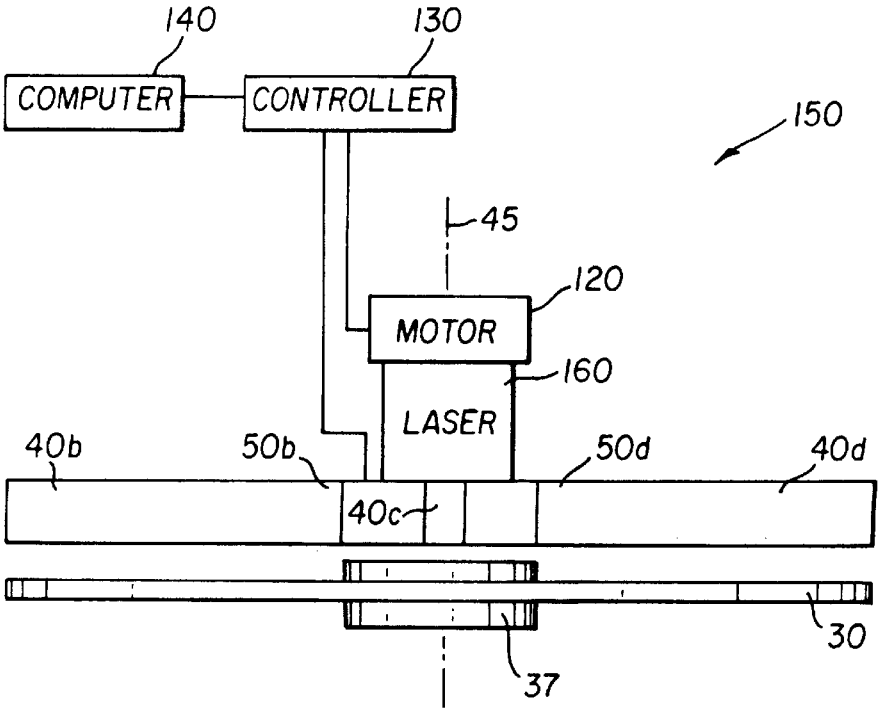
FIG. 4 in a view in elevation of a second embodiment printer for printing indicia on a disk, the printer comprising a plurality of laser print heads enabled by a laser coupled thereto.
Figure 5:
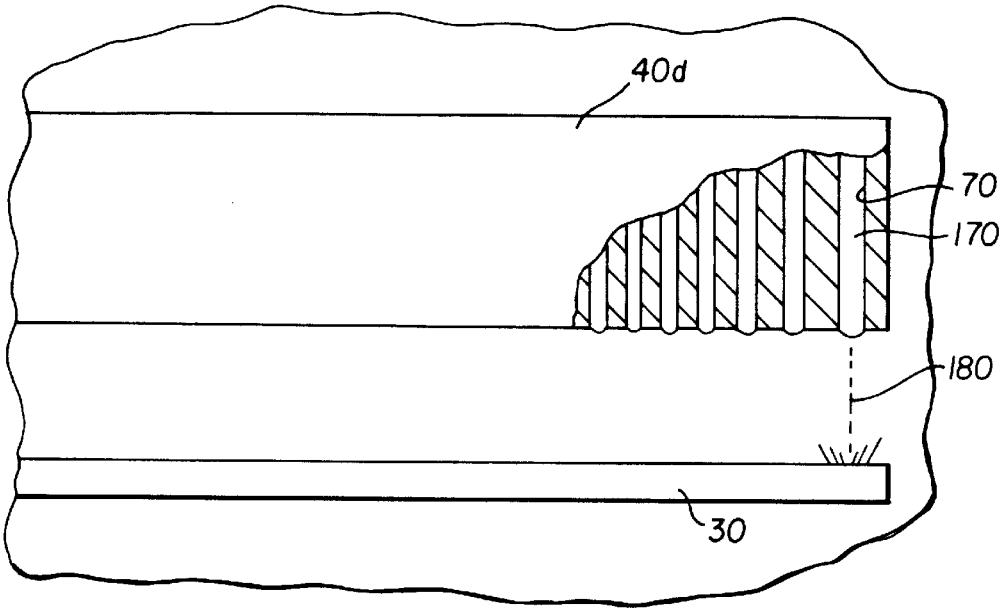
FIG. 5 is an enlarged fragmentation view in partial elevation of one of the laser print heads having a plurality of fiber optic cables disposed therein.

Referring to FIGS. 4 and 5, a second embodiment of the present invention is there shown comprising a second embodiment printer, generally referred to as 150, for printing indicia 20 on disk 30. In this second embodiment of the invention, printer 150 is similar to the first embodiment printer 10, except that print heads 40*a*/*b*/*c*/*d* are laser print heads coupled to a laser 160. Coupling of print heads 40*a*/*b*/*c*/*d* to laser 160 is achieved by means of a plurality of fiber optic cables 170 having end portions received in respective ones of channels 70. Light from laser 160 is transmitted along fiber optic cables 170 to be emitted therefrom as a light beam 180 that is intercepted by disk 30. As light beam 180 is intercepted by disk 30, a portion of disk 30 will vaporize to leave a substantially opaque mark at the point of vaporization. As previously mentioned, disk 30 need not be a recordable compact disk or a read-only memory compact disk. In this regard, disk 30 may any transmissive or reflective receiver (e.g., paper, polymeric plastic, wood, metal, or the like) on which indicia 20 is to be printed. Indeed, use of printer 150 is not preferred for printing indicia 20 on recordable compact disks or a read-only memory compact disks because such laser induced printing may interfere with optical reading of digital information stored or to be written on the disk.

Figure 6:
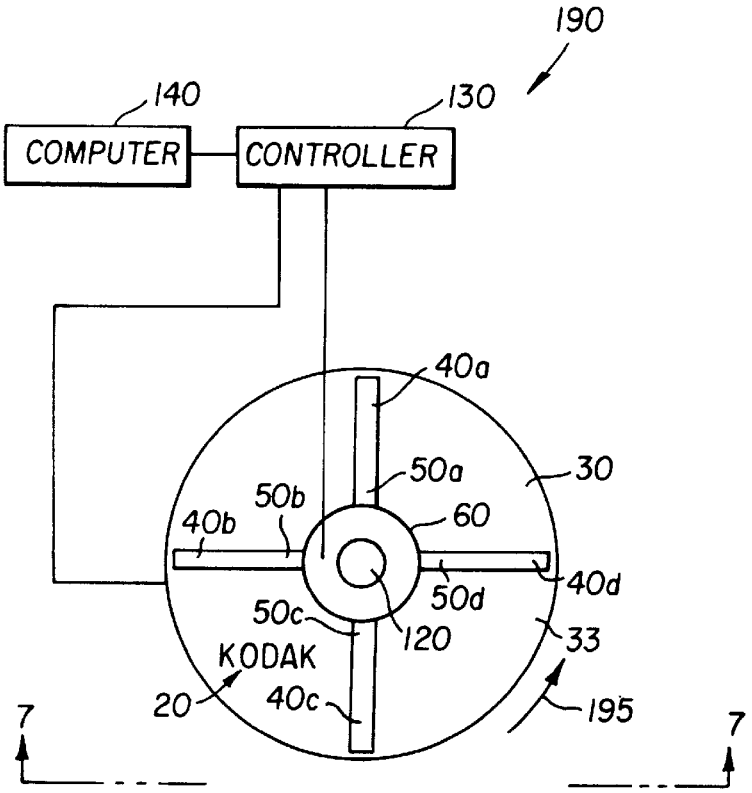
FIG. 6 is a plan view of a third embodiment printer for printing indicia on the disk, the printer comprising a plurality of ink jet print heads arranged in a spoke-like configuration, the spoke-like configuration being stationary while the disk rotates.
Figure 7:
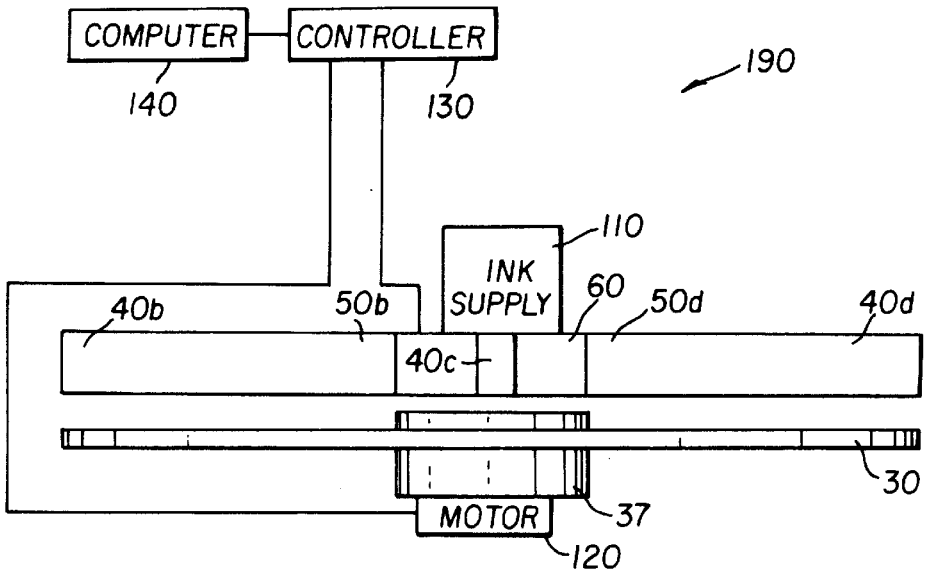
FIG. 7 is a view taken along section line 7—7 of FIG. 6.

Referring to FIGS. 6 and 7, a third embodiment printer, generally referred to as 190, is there shown for printing indicia 20 on disk 30. Third embodiment printer 190 is substantially similar to first embodiment printer 10 except that motor 120 is coupled to spindle 37 for rotating spindle 37. In this manner, disk 30 rotates through a predetermined angle in direction of a second arrow 195 while spindle 37 rotates. In this embodiment of the invention, hub 60 and thus print heads 40*a*/*b*/*c*/*d* are stationary.

Figure 8:
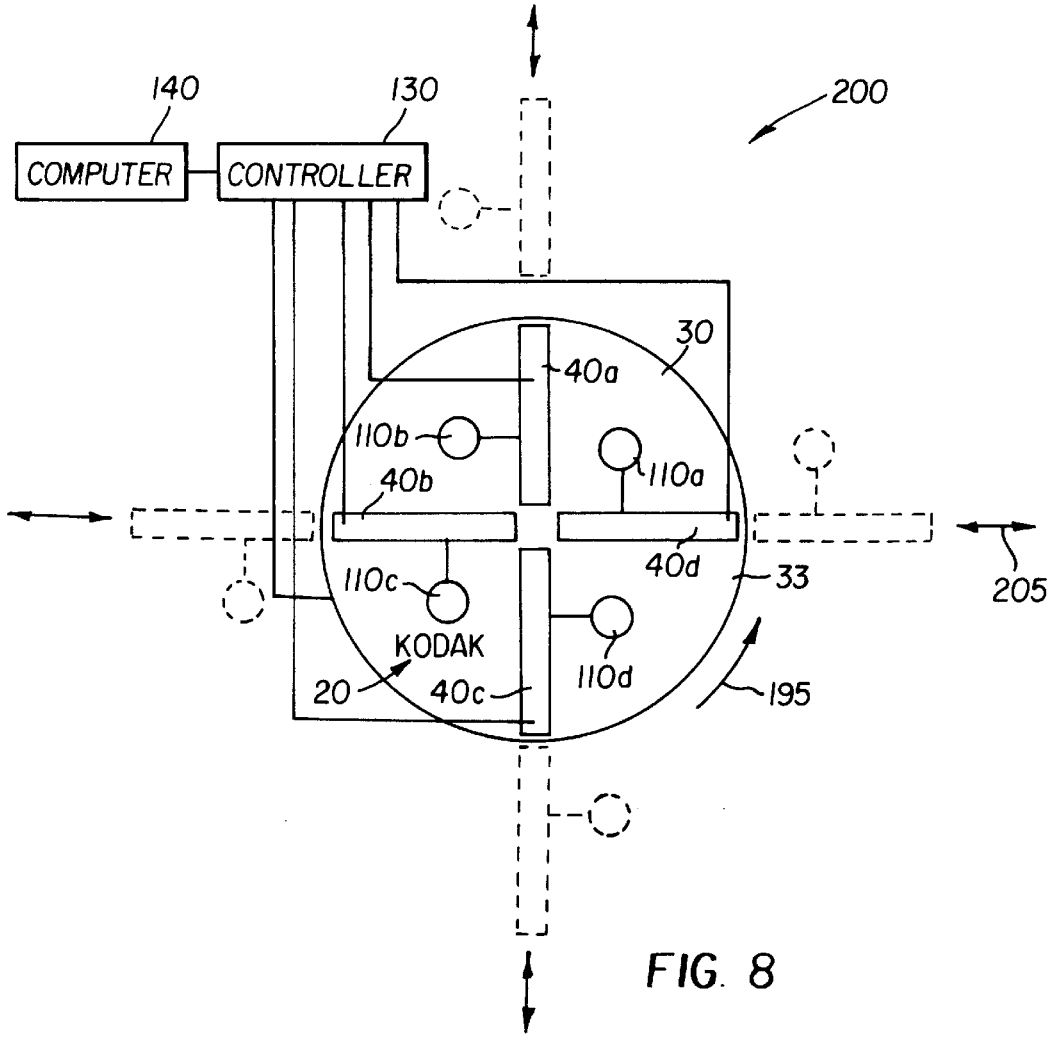
FIG. 8 is a plan view of a fourth embodiment of the present invention showing the print heads being radially movable with respect to the disk while the disk rotates.

Referring to FIG. 8, there is shown a fourth embodiment printer, generally referred to as 200, for printing indicia 20 on disk 30. Fourth embodiment printer 200 is similar to third embodiment printer 190, except that hub 60 is absent and each print head 40*a*/*b*/*c*/*d* is connected to a respective one of a plurality of individual ink supplies 110*a*, 110*b*, 110*c* and 110*d*. Moreover, according to this fourth embodiment of the invention, each print head 40*a*/*b*/*c*/*d* is radially movable, such as in direction of a double-headed third arrow 205. Disk 30 is rotatable in direction of second arrow 195 by means of motor 120. Controller 130 is coupled to motor 120 and to each print head 40*a*/*b*/*c*/*d* for synchronously controlling operation of motor 120 and print heads 40*a*/*b*/*c*/*d*. An advantage of this fourth embodiment of the invention is that if one of the ink supplies 110*a*/*b*/*c*/*d* malfunctions (e.g., ink coagulation or contamination), then the remaining ink supplies can continue to supply ink without interrupting the printing run until the malfunctioning ink supply is replaced or repaired. Of course, fourth embodiment printer 200 is particularly useful when the inks in each ink supply 110*a*/*b*/*c*/*d* is of the same color for printing monochrome indicia 20. Fourth embodiment printer 200 is less useful when the inks in ink supplies 110*a*/*b*/*c*/*d* are each of a different color for printing multicolor indicia 20.

Figure 9:
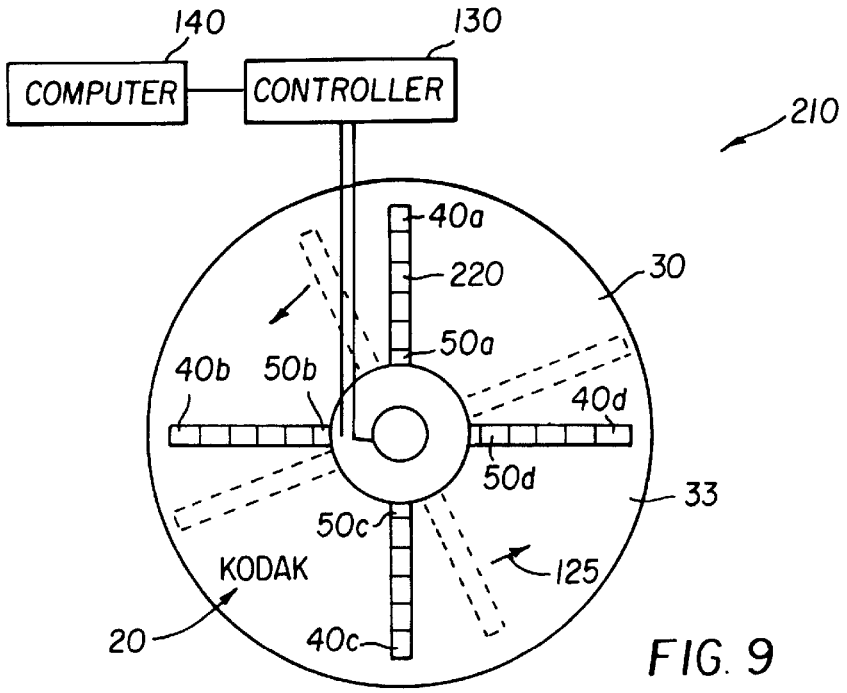
FIG. 9 is a plan view of a fifth embodiment printer for printing indicia on the disk, the printer comprising a plurality of ink jet print heads arranged in a spoke-like configuration, the spoke-like configuration being rotatable while the disk is stationary and the print heads each comprising a plurality of print head segments.
Figure 12:
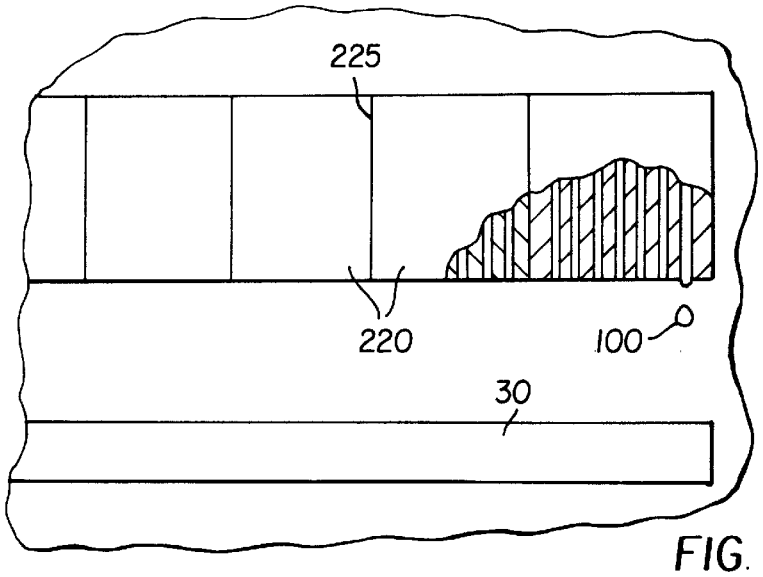
FIG. 12 is an enlarged fragmentation view in partial elevation of one of the ink jet print heads showing a plurality of ink channels therein, the print head comprising a plurality of print head segments

Referring now to FIGS. 9 and 12, there is shown a fifth embodiment printer, generally referred to as 210, for printing indicia 20 on disk 30. Fifth embodiment printer 210 is substantially similar to first embodiment printer 10, except that print heads 40*a*/*b*/*c*/*d* each comprise a plurality of replaceable, adjacent print heads segments 220 arranged end-to-end. The segments 220 are interconnected at joints 225, such as by means of a suitable adhesive or by means of a suitable male-female connection (not shown). It is contemplated herein that this jointed connection allows individual segments 220 to be removed from any of print heads 40*a/b/c/d* and replaced, if necessary. This is particularly useful if any of channels 70 fails to eject ink droplet 100 or ejects droplet 100 along an unintended trajectory. This may occur, for example, if dried ink either completely or partially obstructs channels 70. In this case, segment 220 containing the malperforming channel 70 may be removed and replaced with a segment having all channels 70 therein fully functional.

Figure 10:
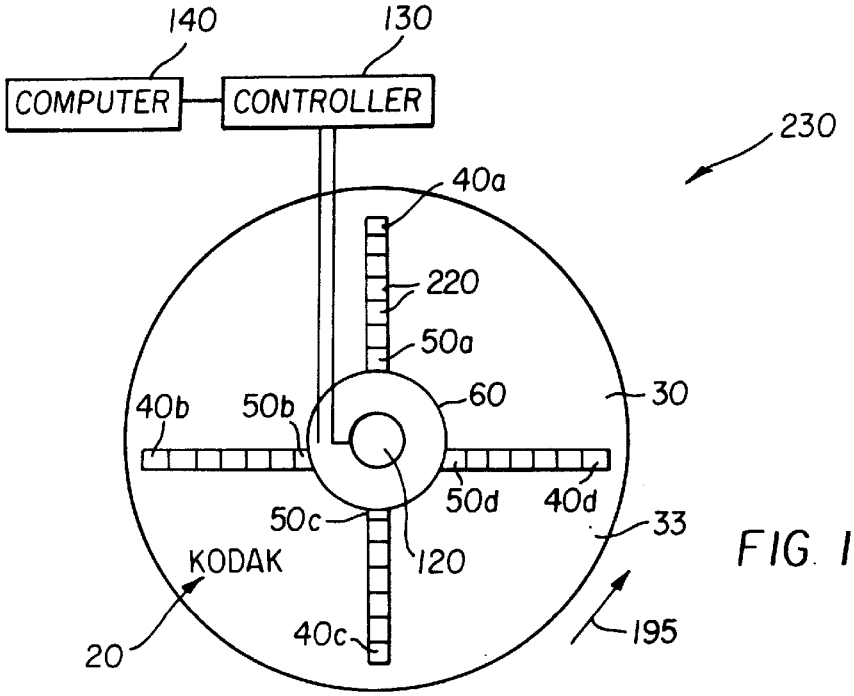
FIG. 10 is a plan view of a sixth embodiment printer for printing indicia on the disk, the printer comprising a plurality of ink jet print heads arranged in a spoke-like configuration, the spoke-like configuration being stationary while the disk rotates and the print heads each comprising a plurality of print head segments.

Referring to FIGS. 10 and 12, there is shown a sixth embodiment printer, generally referred to as 230, for printing indicia 20 on disk 30. Sixth embodiment printer 230 is substantially similar to second embodiment printer 150, except that print heads 40*a/b/c/d* each comprise the plurality of adjacent print heads segments 220 arranged end-to-end.

Figure 11:
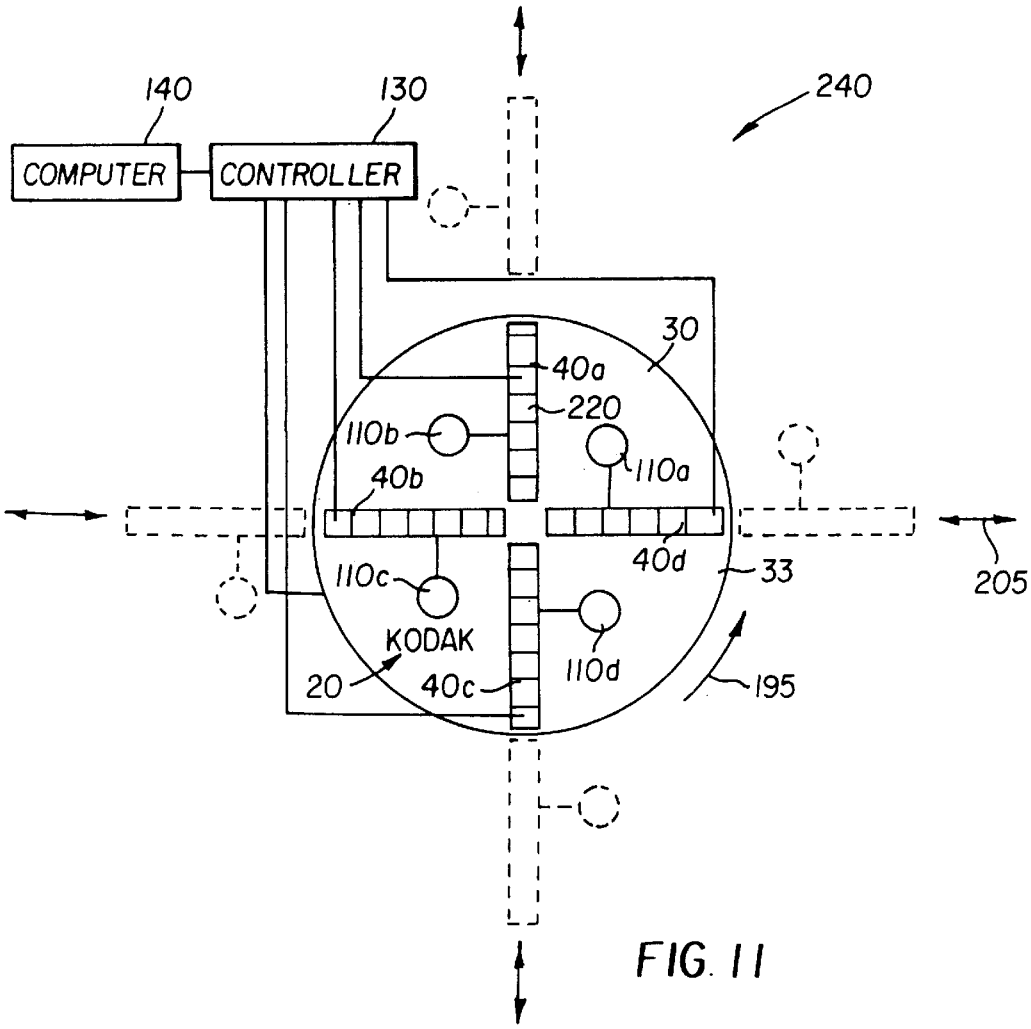
FIG. 11 is a plan view of a seventh embodiment of the present invention showing the print heads being radially movable with respect to the disk while the disk rotates and the print heads each comprising a plurality of print head segments.

Referring to FIGS. 11 and 12, there is shown a seventh embodiment printer, generally referred to as 240, for printing indicia 20 on disk 30. Seventh embodiment printer 240 is substantially similar to fourth embodiment printer 200, except that print heads 40*a/b/c/d* each comprise the plurality of adjacent print heads segments 220 arranged end-to-end.

Figure 13:
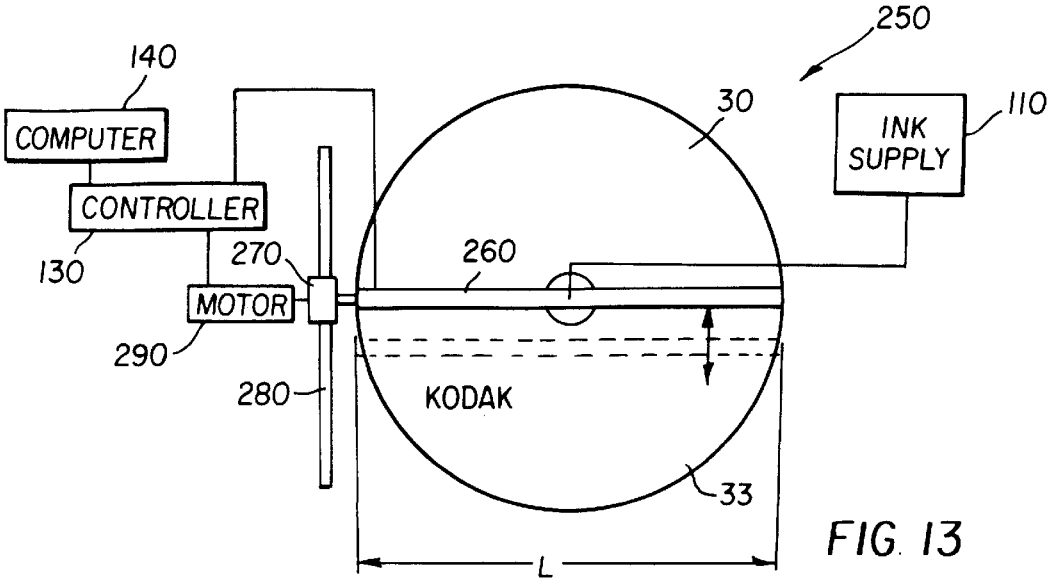
FIG. 13 is a plan view of an eighth embodiment printer showing a single ink jet print head of predetermined length traversing the disk while the disk is stationary.

Referring to FIG. 13, there is shown an eighth embodiment printer, generally referred to as 250, for printing indicia 20 on disk 30. Eighth embodiment printer 250 comprises a single print head 260 having a predetermined length "L" substantially equal to diameter of disk 30. A guide 270 is coupled to print head 260 for translating print head 260 over printing area 33. Guide 270 slidably engages an elongate rail 280 disposed adjacent to disk 30 and extending parallel thereto. A motor 290 is coupled to guide 270 for moving guide 270 along rail 280, so that print head 260 traverses over area 33. Controller 130 is coupled to motor 290 and print head 260 for synchronously controlling operation thereof. Ink supply 110 is coupled to print head 260 for supplying ink to print head 260. According to this eighth embodiment of the invention, print head 260 translates over area 33 while disk 30 is stationary.

Figure 14:
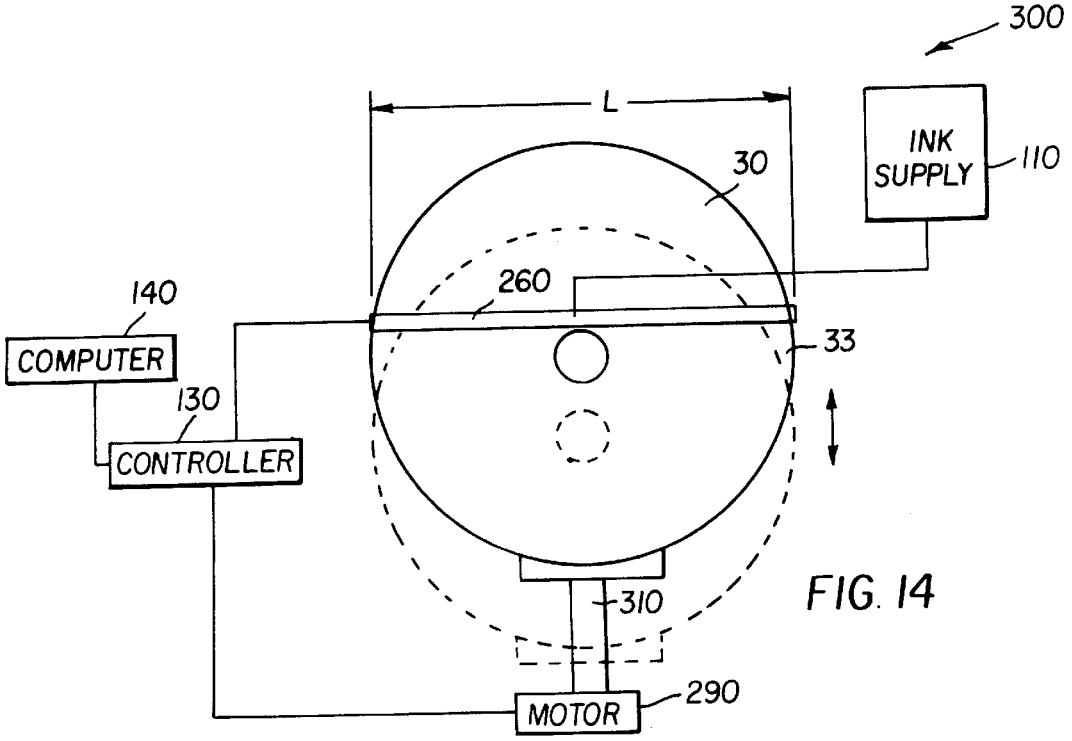
FIG. 14 is a plan view of a ninth embodiment printer showing a single ink jet print head of predetermined length and the disk traversing the print head while the print head is stationary.

Referring to FIG. 14, there is shown a ninth embodiment printer, generally referred to as 300, for printing indicia 20 on disk 30. Ninth embodiment printer 300 is similar to eighth embodiment printer 250, except that guide 270 and rail 270 are absent and an arm 310 releasably engages an edge portion of disk 30 (as shown) for moving disk 30 past print head 260. In this case, motor 290 is coupled to arm 310 for moving arm 310, so that arm 310 translates disk 30 past print head 260 for printing. According to this ninth embodiment of the invention, print head 260 is stationary while disk 30 translates.

Figure 15:
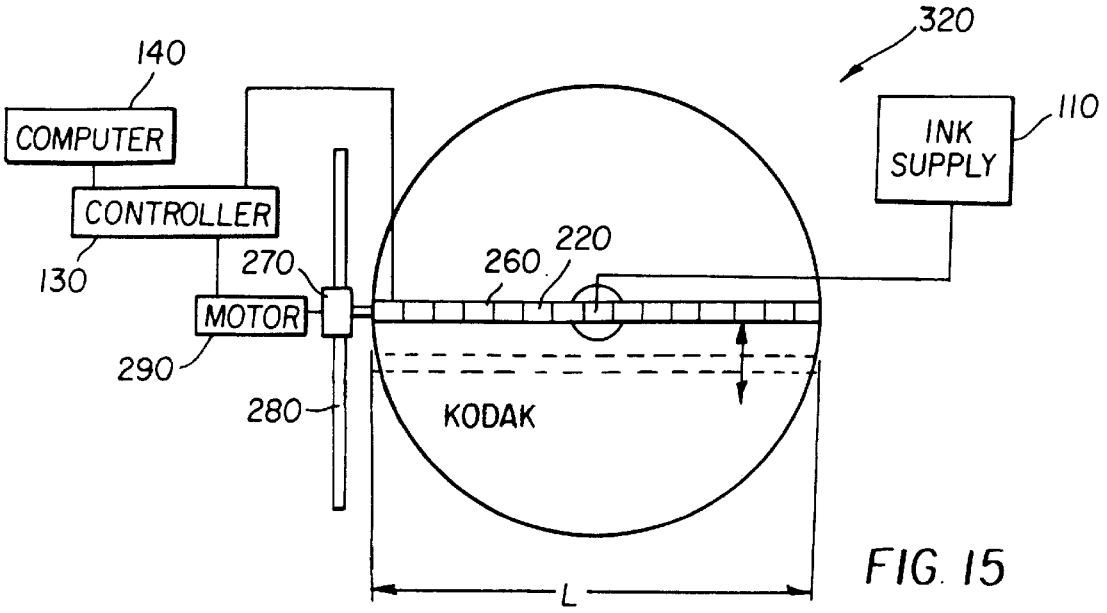
FIG. 15 is a plan view of a tenth embodiment printer showing the single ink jet print head of predetermined length traversing the disk while the disk is stationary, the print head comprising a plurality of print head segments.

Referring to FIG. 15, there is shown a tenth embodiment printer, generally referred to as 320, for printing indicia 20 on disk 30. Tenth embodiment printer 320 is substantially similar to eighth embodiment printer 250, except that print head 260 comprises the plurality of print head segments 220.

Figure 16:
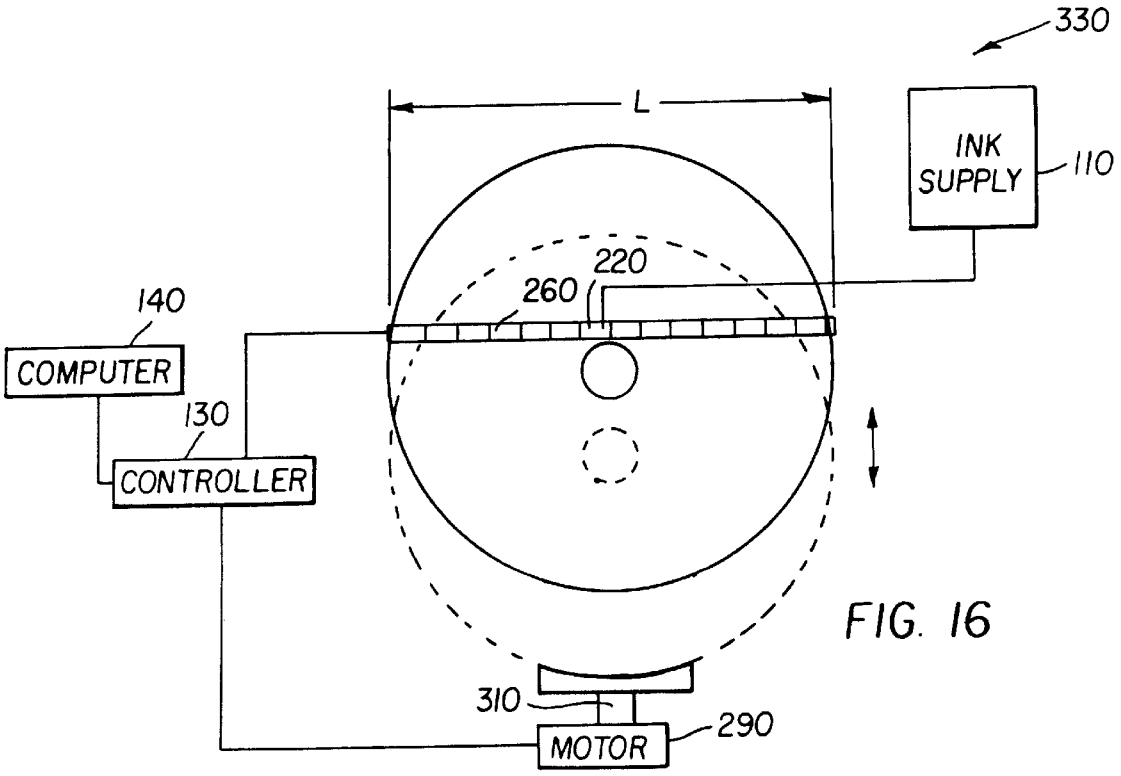
FIG. 16 is a plan view of an eleventh embodiment printer showing the single ink jet print head of predetermined length and the disk traversing the print head while the print head is stationary, the print head comprising a plurality of print head segments.

Referring to FIG. 16, there is shown an eleventh embodiment printer, generally referred to as 330, for printing indicia 20 on disk 30. Eleventh embodiment printer 330 is substantially similar to ninth embodiment printer 300, except that print head 260 comprises the plurality of print head segments 220.

Figure 17:
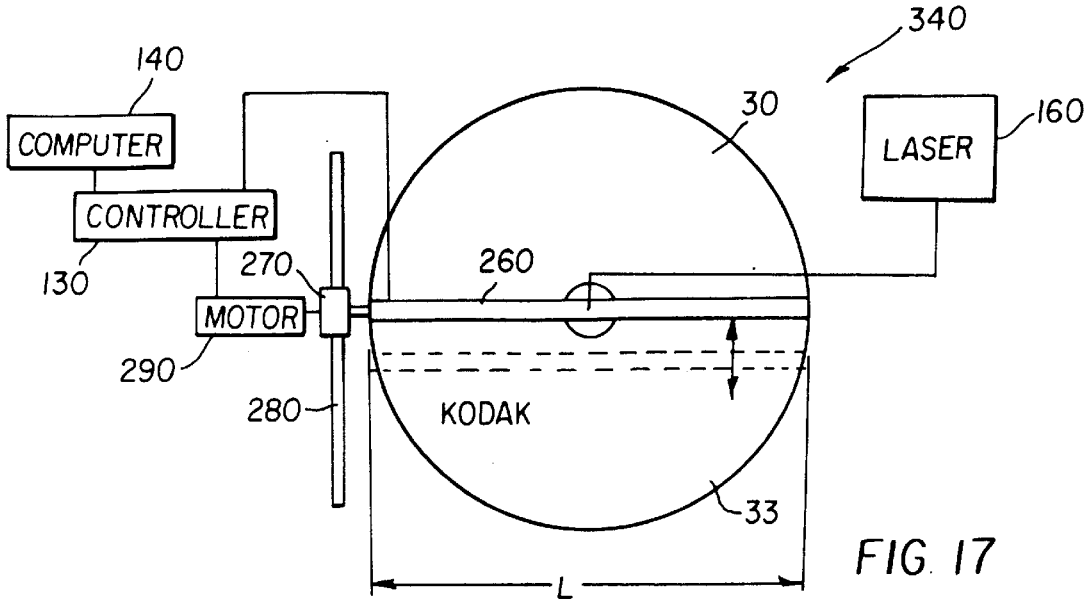
FIG. 17 is a plan view of a twelfth embodiment of the invention showing a single laser print head of predetermined length traversing the disk while the disk is stationary.

Referring to FIG. 17, there is shown a twelfth embodiment printer, generally referred to as 340, for printing indicia 20 on disk 30. Twelfth embodiment printer 340 is substantially similar to eighth embodiment printer 250, except that print head 260 is a laser print head enabled by laser 160.

Figure 18:
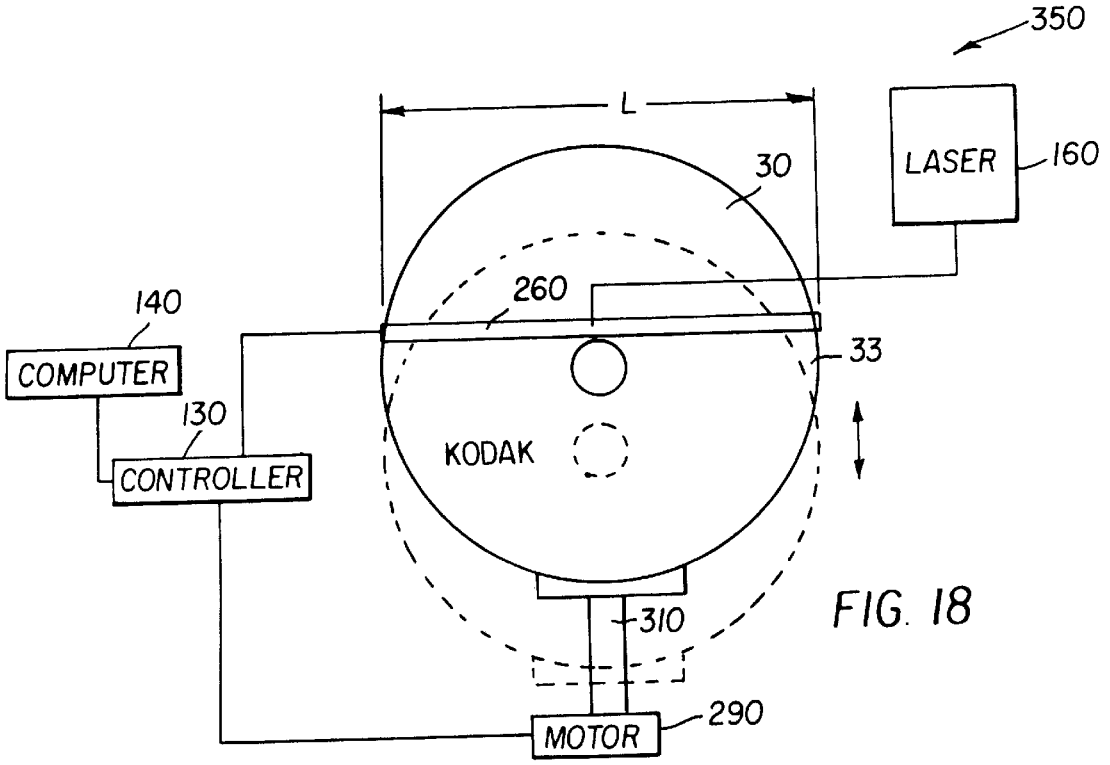
FIG. 18 is a plan view of a thirteenth embodiment printer showing a single laser print head of predetermined length and the disk traversing the print head while the print head is stationary.

Referring to FIG. 18, there is shown a thirteenth embodiment printer, generally referred to as 350, for printing indicia 20 on disk 30. Thirteenth embodiment printer 350 is substantially similar to ninth embodiment printer 300, except that print head 260 is a laser print head enabled by laser 160.

Figure 19:
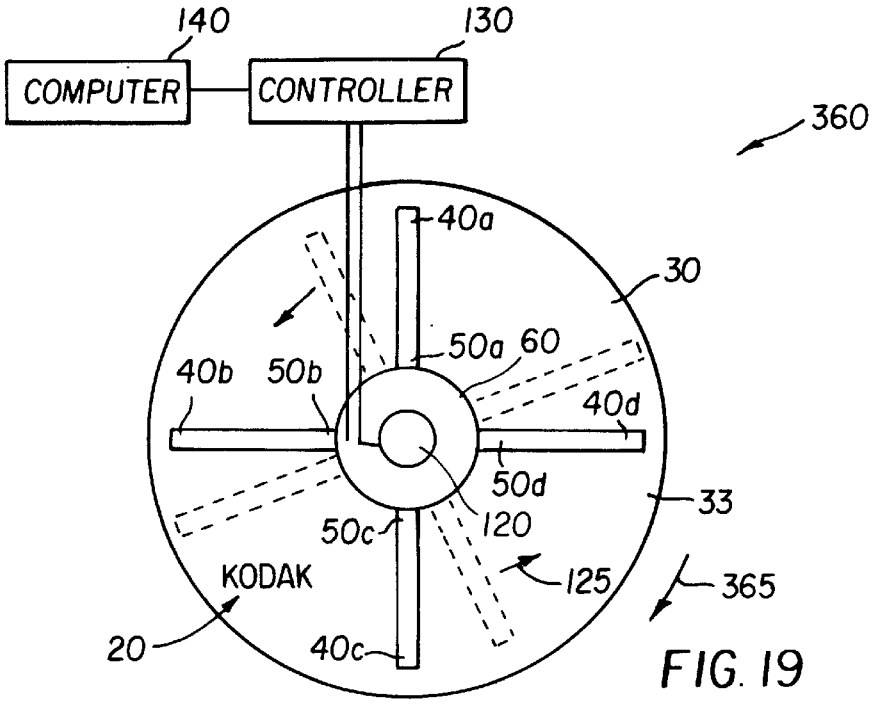
FIG. 19 is a plan view of a fourteenth embodiment printer for printing indicia on a disk, the printer comprising a plurality of ink jet print heads arranged in a spoke-like configuration, the spoke-like configuration being rotatable while the disk rotates.

Referring to FIG. 19, there is shown a nineteenth embodiment printer, generally referred to as 360, for printing indicia 20 on disk 30. Nineteenth embodiment printer 360 is substantially similar to first embodiment printer 10, except that print heads 40*a/b/c/d* rotate in unison as disk rotates in direction of fourth arrow 365. However, it may be appreciated that direction of rotation as illustrated by fourth arrow 365 may be in an opposite direction. That is, in the preferred embodiment, direction of fourth arrow 365 is in the counterclockwise direction; however, direction of rotation may be selected as in the clockwise direction, if desired. However, in this latter case, speed of rotation of printheads 40*a/b/c/d* is different than rotational speed of disk 30 (e.g., speed of print heads 40*a/b/c/d* is faster than speed of disk 30).

Figure 20:
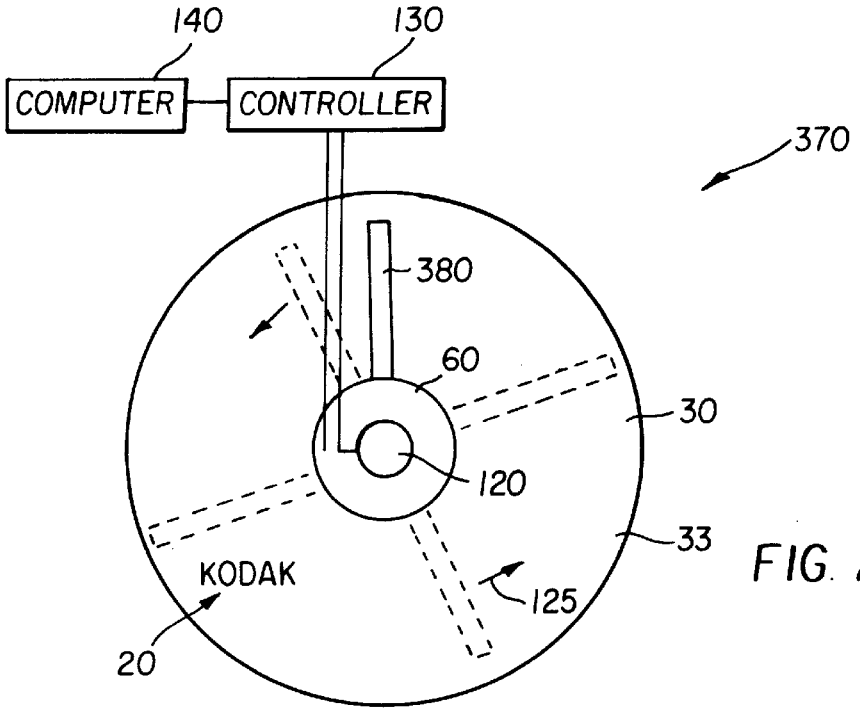
FIG. 20 is a plan view of a fifteenth embodiment printer for printing indicia on a disk, the printer comprising a single ink jet print head arranged in a spoke-like configuration, the spoke-like configuration being rotatable while the is stationary.

Referring to FIG. 20, there is shown a twentieth embodiment printer, generally referred to as 370, for printing indicia 20 on disk 30. Twentieth embodiment printer 370 is substantially similar to first embodiment printer 10, except that the plurality of print heads 40*a/b/c/d* are replaced by a single print head 380 (as shown).

It may be appreciated that an advantage of the present invention is that use thereof increases printing speed when printing indicia 20 on an individual disk 30. This is so because the plurality of the print heads 40*a/b/c/d*, rather than a single print head, are used to print the indicia 20.

It may be appreciated that another advantage of the present invention is that printing costs are reduced. This is so because the fifth, sixth and seventh embodiments of the invention each includes replaceable print head segments 220. Thus, if a channel 70 malfunctions, then the segment 220 including that channel 70 may be replaced by a segment 220 having fully operable channels 70. This technique reduces printing costs because the entire print head need not be replaced; rather, only the segment 220 having the malfunctioning channel 70 is replaced.

It may be appreciated that still another advantage of the present invention is that use thereof allows for a flexible manufacturing process. This is so because form and content of indicia 20 may be readily changed by an operator of printer by means of changing input to computer 140.

While the invention has been described with particular reference to its preferred embodiments, it will be understood by those skilled in the art that various changes may be made and equivalents may be substituted for elements of the preferred embodiments without departing from the invention. For example, there may be one or more ink sensors associated with each print head 40*a/b/c/d* to sense inadvertent leakage of ink from print heads 40*a/b/c/d*. As another example, there may be a another sensor that is associated with spindle 37 for sensing if disk 30 is properly positioned with respect to print heads 40*a/b/c/d*, so that print heads 40*a/b/c/d* properly print indicia 20 on disk 30. As yet another example, print heads 40*a/b/c/d* need not be ink jet or laser print heads; rather, print heads 40*a/b/c/d* may be any type of print heads suitable for printing indicia 20 on disk 30.

Therefore, what is provided is a printer and method for printing indicia on a disk, such that printing speed is increased and printing costs are reduced.

| PARTS LIST | |
|---|---|
| L | length of single print head |
| 10 | first embodiment printer |
| 20 | indicia |
| 30 | disk |
| 33 | printing area |
| 35 | hole |
| 37 | spindle |
| 40a/b/c/d | print heads |
| 45 | center axis |
| 50a/b/c/d | end portions of print heads |
| 60 | hub |
| 70 | ink channels |
| 80 | ink body |
| 90a/b | sidewalls |
| 100 | ink droplet |
| 110 | ink supply |
| 120 | motor |
| 125 | first arrow |
| 130 | controller |
| 140 | computer |
| 150 | second embodiment printer |
| 160 | laser |
| 170 | fiber optic cables |
| 180 | light beam |
| 190 | third embodiment printer |
| 195 | second arrow |
| 200 | fourth embodiment printer |
| 205 | third arrow |
| 210 | fifth embodiment printer |
| 220 | print head segments |
| 225 | joints |
| 230 | sixth embodiment printer |
| 240 | seventh embodiment printer |
| 250 | eighth embodiment printer |
| 260 | single print head |
| 270 | guide |
| 280 | rail |
| 290 | motor |
| 300 | ninth embodiment printer |
| 310 | arm |
| 320 | tenth embodiment printer |
| 330 | eleventh embodiment printer |
| 340 | twelfth embodiment printer |
| 350 | thirteenth embodiment printer |
| 360 | nineteenth embodiment printer |
| 365 | fourth arrow |
| 370 | twentieth embodiment printer |
| 380 | solitary print head |

What is claimed is:

1. A printer for printing indicia on a disk, comprising a plurality of print heads arranged in a spoke-like configuration about a center axis defined between said print heads, said print heads capable of being disposed in printing relation to the disk, wherein the disk is stationary and said print heads are rotatable about the center axis while the disk is stationary.

2. The printer of claim 1, further comprising a controller coupled to said print heads for controlling operation of said print heads.

3. The printer of claim 1, wherein each of said print heads comprises a plurality of print head segments.

4. A printer for printing indicia on a disk, comprising a plurality of print heads arranged in a spoke-like configuration about a center axis defined between said print heads, said print heads capable of being disposed in printing relation to the disk, wherein the disk is rotatable about the center axis and said print heads are stationary while the disk rotates.

5. The printer of claim 4, further comprising a controller coupled to said print heads for controlling operation of said print heads.

6. A printer for printing indicia on a disk, comprising a plurality of print heads arranged in a spoke-like configuration about a center axis defined between said print heads, said print heads capable of being disposed in printing relation to the disk, wherein the disk is rotatable and each of said print heads is radially movable with respect to the disk while the disk rotates.

7. The printer of claim 6, further comprising a controller coupled to said print heads for controlling operation of said print heads.

8. A printer for printing indicia on a disk, comprising a plurality of print heads arranged in a spoke-like configuration about a center axis defined between said print heads, said print heads capable of being disposed in printing relation to the disk, wherein the said print heads are rotatable while the disk rotates.

9. The printer of claim 8, further comprising a controller coupled to said print heads for controlling operation of said print heads.

10. A printer for printing indicia on a compact disk having an annular printing area, comprising a plurality of elongate print heads arranged orthogonally with respect to each other about a center axis defined therebetween, said print heads disposed in printing relation to the printing area.

11. The printer of claim 10, further comprising:

(a) a hub centered at the center axis and coupled to said print heads, so that said print heads radiate outwardly from said hub;

(b) a motor coupled to said hub for rotating said hub about the center axis while the disk is stationary, so that said print heads rotate in unison about the center axis while the disk is stationary; and (c) a controller coupled to said motor and said print heads for synchronously controlling operation thereof.

12. The printer of claim 10, further comprising:

(a) a stationary hub centered at the center axis and coupled to said print heads, so that said print heads radiate outwardly from said hub and are stationary;

(b) a motor coupled to the disk for rotating the disk while the print heads are stationary; and (c) a controller coupled to said motor and said print heads for synchronously controlling operation thereof.

13. The printer of claim 10, wherein each of said print heads is radially movable and the disk is rotatable, so that each of said print heads radially moves relative to the printing area while the disk rotates.

14. The printer of claim 10, wherein each of said print heads comprises a plurality of adjacent print head segments.

15. The printer of claim 10, wherein each of said print heads is an ink jet print head.

16. The printer of claim 10, wherein each of said print heads is a laser print head.

17. The printer of claim 16, further comprising a laser coupled to said print heads for supplying laser light thereto.

18. A printer for printing indicia on a stationary compact disk having a diameter and an annular printing area, comprising:

(a) an elongate print head having a predetermined length substantially equal to the diameter of the disk for printing the indicia in the printing area; and (b) a guide coupled to said print head for translating said print head over the printing area, so that said print head translates while the disk is stationary.

19. The printer of claim 18, further comprising:

(a) a motor coupled to said guide for moving said guide, so that said print head translates while said guide moves; and (b) a controller coupled to said motor and said print head for synchronously controlling operation thereof.

20. The printer of claim 18, wherein said print head comprises a plurality of adjacent print head segments.

21. The printer of claim 18, wherein said print head is an ink jet print head.

22. The printer of claim 18, wherein said print head is a laser print head.

23. The printer of claim 22, further comprising a laser coupled to said print head for supplying laser light thereto.

24. A method of assembling a printer capable of printing indicia on a disk, comprising the step of arranging a plurality of print heads in a spoke-like configuration about a center axis defined between the print heads so that the print heads are capable of being disposed in printing relation to the disk, wherein the step of arranging a plurality of print heads comprises the step of arranging the plurality of print heads, so that the print heads are rotatable while the disk is stationary.

25. The method of claim 24, further comprising the step of coupling a controller to the print heads for controlling operation of the print heads.

26. The method of claim 24, wherein the step of arranging a plurality of print heads comprises the step of arranging the plurality of print heads such that each of the print head has a plurality of print head segments.

27. A method of assembling a printer capable of printing indicia on a disk, comprising the step of arranging a plurality of print heads in a spoke-like configuration about a center axis defined between the print heads so that the print heads are capable of being disposed in printing relation to the disk, wherein the step of arranging a plurality of print heads comprises the step of arranging the plurality of print heads, so that the print heads are stationary while the disk rotates.

28. The method of claim 27, further comprising the step of coupling a controller to the print heads for controlling operation of the print heads.

29. A method of assembling a printer capable of printing indicia on a disk, comprising the step of arranging a plurality of print heads in a spoke-like configuration about a center axis defined between the print heads so that the print heads are capable of being disposed in printing relation to the disk, wherein the step of arranging a plurality of print heads comprises the step of arranging the plurality of print heads, so that each of the print heads radially moves while the disk rotates.

30. The method of claim 29, further comprising the step of coupling a controller to the print heads for controlling operation of the print heads.

31. A method of assembling a printer capable of printing indicia on a disk, comprising the step of arranging a plurality of print heads in a spoke-like configuration about a center axis defined between the print heads so that the print heads are capable of being disposed in printing relation to the disk, wherein the step of arranging a plurality of print heads comprises the step of arranging the plurality of print heads, so that the print heads rotate while the disk rotates.

32. The method of claim 31, further comprising the step of coupling a controller to the print heads for controlling operation of the print heads.

33. A method of assembling a printer capable of printing indicia on a compact disk having an annular printing area, comprising the step of arranging a plurality of elongate print heads orthogonally with respect to each other about a center axis defined therebetween, the print heads capable of being disposed in printing relation to the printing area.

34. The method of claim 33, further comprising the steps of:

(a) coupling the print heads to a hub centered at the center axis, so that the print heads radiate outwardly from the hub;

(b) coupling a motor to the hub for rotating the hub about the center axis while the disk is stationary, so that the print heads rotate in unison about the center axis while the disk is stationary; and (c) coupling a controller to the motor and the print heads for synchronously controlling operation thereof.

35. The method of claim 33, further comprising the steps of:

(a) coupling the print heads to a stationary hub centered at the center axis, so that the print heads radiate outwardly from the hub and are stationary;

(b) coupling a motor to the disk for rotating the disk while the print heads are stationary; and (c) coupling a controller to the motor and the print heads for synchronously controlling operation thereof.

36. The method of claim 33, wherein the step of arranging a plurality of print heads comprises the step of arranging the plurality of print heads such that each of the print heads radially moves relative to the printing area while the disk rotates.

37. The method of claim 33, wherein the step of arranging a plurality of print heads comprises the step of arranging the plurality of print heads such that each of the print heads has a plurality of adjacent print head segments.

38. The method of claim 33, wherein the step of arranging a plurality of print heads comprises the step of arranging a plurality of ink jet print heads.

39. The method of claim 33, wherein the step of arranging a plurality of print heads comprises the step of arranging a plurality of laser print heads.

40. The method of claim 39, further comprising the step of coupling a laser to the print heads for supplying laser light thereto.

41. A method of assembling a printer capable of printing indicia on a stationary compact disk having a diameter and an annular printing area, comprising the steps of:

(a) providing an elongate print head having a predetermined length substantially equal to the diameter of the disk for printing the indicia in the printing area; and (b) coupling a guide to the print head for translating the print head over the printing area, so that the print head translates while the disk is stationary.

42. The method of claim 41, further comprising the steps of:

(a) coupling a motor to the guide for moving the guide, so that the print head translates while the guide moves; and (b) coupling a controller to the motor and the print head for synchronously controlling operation thereof.

43. The method of claim 41, wherein the step of providing a print head comprises the step of providing a print head having a plurality of adjacent print head segments.

44. The method of claim 41, wherein the step of providing a print head comprises the step of providing an ink jet print head.

45. The method of claim 41, wherein the step of providing a print head comprises the step of providing a laser print head.

46. The method of claim 45, further comprising the step of coupling a laser to the print head for supplying laser light thereto.

47. A method of printing indicia on a disk, comprising the steps of:

(a) disposing a plurality of print heads in printing relation to the disk, the print heads being arranged in a spoke-like configuration about a center axis defined between the print heads, so that the print heads are rotatable while the disk is stationary; and (b) operating the print heads to print the indicia on the disk.

48. The method of claim 47, further comprising the step of controlling operation of the print heads by operating a controller coupled to the print heads.

49. The method of claim 47, wherein the step of disposing a plurality of print heads comprises the step of disposing the plurality of print heads, wherein each of the print heads has a plurality of print head segments.

50. A method of printing indicia on a disk, comprising the steps of:

(a) disposing a plurality of print heads in printing relation to the disk, the print heads being arranged in a spoke-like configuration about a center axis defined between the print heads, wherein the print heads are stationary while the disk rotates; and (b) operating the print heads to print the indicia on the disk.

51. A method of printing indicia on a disk, comprising the steps of:

(a) disposing a plurality of print heads in printing relation to the disk, the print heads being arranged in a spoke-like configuration about a center axis defined between the print heads, wherein each of the print heads radially moves while the disk rotates; and (b) operating the print heads to print the indicia on the disk.

52. A method of printing indicia on a disk, comprising the steps of:

(a) disposing a plurality of print heads in printing relation to the disk, the print heads being arranged in a spoke-like configuration about a center axis defined between the print heads, wherein the print heads rotate while the disk rotates; and (b) operating the print heads to print the indicia on the disk.

53. A method of printing indicia on a compact disk having an annular printing area, comprising the steps of:

(a) disposing a plurality of elongate print heads in printing relation to the printing area, the print heads being arrancged orthogonally with respect to each other about a center axis defined therebetween; and (b) operating the print heads to print the indicia on the disk.

54. The method of claim 53, further comprising the step of:

(a) rotating the print heads in unison about the center axis while the disk is stationary by operating a motor coupled to a hub centered at the center axis, the hub having the print heads coupled therto such that the print heads radiate outwardly from the hub; and (b) synchronously controlling operation of the motor and the print heads by operating a controller coupled to the motor and the print heads.

55. The method of claim 53, further comprising the step of:

(a) rotating the disk while the print heads are stationary by operating a motor coupled to the disk, the print heads being coupled to a stationary hub centered at the center axis so that the print heads radiate outwardly from the hub; and (b) synchronously controlling operation of the motor and the print heads by operating a controller coupled to the motor and the print heads.

56. The method of claim 53, wherein the step of disposing a plurality of elongate print heads comprises the step of radially moving at least one or the print heads relative to the printing area while the disk rotates.

57. The method of claim 53, wherein the step of disposing a plurality of elongate print heads comprises the step of disposing the plurality of print heads, each of the print heads having a plurality of adjacent print head segments.

58. The method of claim 53, wherein the step of disposing a plurality of print heads comprises the step of disposing a plurality of ink jet print heads.

59. The method of claim 53, wherein the step of disposing a plurality of print heads comprises the step of disposing a plurality of laser print heads.

60. The method of claim 59, further comprising the step of supplying laser light to the laser print heads by operating a laser coupled to the print heads.

* * * * *